US012624613B2

(12) United States Patent
Arumugam et al.

(10) Patent No.: US 12,624,613 B2
(45) Date of Patent: May 12, 2026

(54) INTEGRATED SCREEN FOR ELECTRICAL FLOW CONTROL VALVE

(71) Applicant: Schlumberger Technology Corporation, Sugar Land, TX (US)

(72) Inventors: Arun Arumugam, Rosharon, TX (US); Nabil Batita, Houston, TX (US); David Lardy, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 142 days.

(21) Appl. No.: 18/714,203

(22) PCT Filed: Dec. 7, 2022

(86) PCT No.: PCT/US2022/081100
§ 371 (c)(1),
(2) Date: May 29, 2024

(87) PCT Pub. No.: WO2023/108011
PCT Pub. Date: Jun. 15, 2023

(65) Prior Publication Data

US 2025/0020041 A1 Jan. 16, 2025

Related U.S. Application Data

(60) Provisional application No. 63/265,078, filed on Dec. 7, 2021.

(51) Int. Cl.

| | |
|---|---|
| ***E21B 34/06*** | (2006.01) |
| ***E21B 17/042*** | (2006.01) |
| ***E21B 17/046*** | (2006.01) |
| ***E21B 43/08*** | (2006.01) |

(52) U.S. Cl.
CPC ..... *E21B 34/066* (2013.01); *E21B 17/042* (2013.01); *E21B 17/046* (2013.01); *E21B 43/08* (2013.01)

(58) Field of Classification Search
CPC ..... E21B 43/12; E21B 17/042; E21B 17/046
See application file for complete search history.

(56) References Cited

U.S. PATENT DOCUMENTS

| | | | | |
|---|---|---|---|---|
| 2003/0079878 | A1 | 5/2003 | Pramann, II et al. | |
| 2011/0024105 | A1* | 2/2011 | Hammer | E21B 34/14 166/205 |
| 2015/0218915 | A1* | 8/2015 | Langlais | E21B 43/04 166/278 |
| 2015/0315881 | A1* | 11/2015 | Bowen | E21B 43/084 166/227 |
| 2019/0186240 | A1 | 6/2019 | Fitzhugh et al. | |

OTHER PUBLICATIONS

International Search Report and Written Opinion issued on Apr. 19, 2023 in PCT Application No. PCT/2022/081100.

* cited by examiner

*Primary Examiner* — Kristyn A Hall
(74) *Attorney, Agent, or Firm* — Kyle R. Miiller

(57) ABSTRACT

A screen is integrated with or connected to an electric flow control valve via a flow-through 3-way sub, wherein the 3-way sub comprises: a first connection configured to couple to the electric flow control valve; a second connection configured to couple to the screen; a third connection configured to couple to an inner string disposed at least partially within the screen; and one or more flow through ports configured to direct flow from the electric flow control valve to an annulus of the screen.

20 Claims, 8 Drawing Sheets

| Section | Flow Area ($in^2$) |
|---|---|
| S-1 | 6.1 |
| S-2 | 6.2 |
| S-3 (Annulus) | 27 |

INTEGRATED SCREEN FOR ELECTRICAL FLOW CONTROL VALVE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage Entry of International Application No. PCT/US2022/081100, filed Dec. 7, 2022, which claims priority benefit of U.S. Provisional Application No. 63/265,078, filed Dec. 7, 2021, the entirety of which is incorporated by reference herein and should be considered part of this specification.

BACKGROUND

Field

The present disclosure generally relates to integration of a screen with an electric flow control valve.

Description of the Related Art

Oil and gas wells can include one or more downhole flow control valves (FCVs). FCVs can control the flow of fluid (e.g., hydrocarbons) from the exterior of the FCV to the interior of the FCV and into the production tubing string and/or the flow of fluid (e.g., injection fluid) from the interior of the FCV to the exterior of the FCV. FCVs operate via actuation means such as hydraulic, electric, and/or wireless technologies, or combinations thereof, and may not require mechanical intervention.

SUMMARY

In some configurations, a 3-way sub for integrating a screen with an electric flow control valve includes: a first connection configured to couple to the electric flow control valve; a second connection configured to couple to the screen; a third connection configured to couple to an inner string disposed at least partially within the screen; and one or more flow through ports configured to direct flow from the electric flow control valve to an annulus of the screen.

The one or more flow through ports can include a plurality of flow through ports disposed circumferentially about the 3-way sub. The inner string can be eccentric or offset within the screen. A shroud can direct the flow from the electric flow control valve to the flow through ports. A central bore of the 3-way sub can be eccentric relative to an outer diameter of the 3-way sub.

In some configurations, an integrated screen and electric flow control valve system includes an electric flow control valve, a screen, and a sub coupling the electric flow control valve to the screen, the sub disposed at least partially axially between the electric flow control valve and the screen.

The system can include a first connection coupling the sub to the electric flow control valve and a second connection coupling the sub to the screen. The second connection can be a quick connect coupling. The first connection can be formed between an outer surface of the sub and an inner surface of the electric flow control valve. The first connection can be disposed at an uphole end of the sub, and the second connection can be disposed at a downhole end of the sub.

The system can further include an inner string disposed at least partially within the sub and the screen. A third connection can couple the sub to the inner string. The third connection can be a threaded connection. The third connection can be formed between an inner surface of the sub and an outer surface of the inner string. The first connection can be disposed at an uphole end of the sub, the second connection can be disposed at a downhole end of the sub, and the third connection can be disposed axially between the first and second connections.

The sub can include one or more axially extending flow ports configured to direct injection flow from the electric flow control valve to an annulus of the screen. The system can include a shroud disposed about at least a portion of the electric flow control valve and the sub, the shroud configured to direct the injection fluid flow from the electric flow control valve to the sub. The system can include an inner string disposed at least partially within the sub and the screen, the annulus of the screen formed radially between the screen and the inner string. The system can include a seal sub coupled to a downhole end of the inner string. The seal sub can be disposed within a polished bore receptacle.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
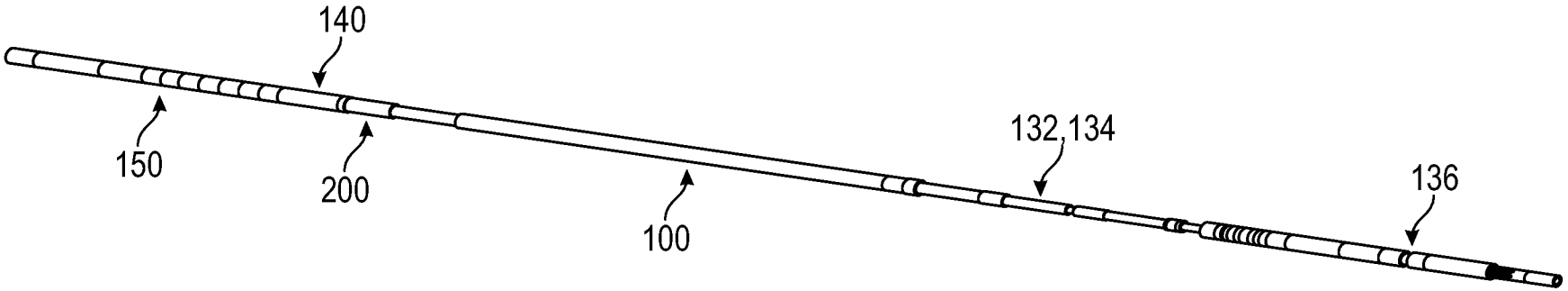
FIG. 1 shows a perspective view of a standalone screen integrated with an electric flow control valve via a 3-way sub.

The present disclosure provides systems and methods for integrating a standalone screen 100 with an electric flow control valve 150. In some configurations, for example as shown in FIG. 1, the screen 100 is integrated or connected with the electric flow control valve 150 via a flow-through 3-way sub 200.

Figure 2:
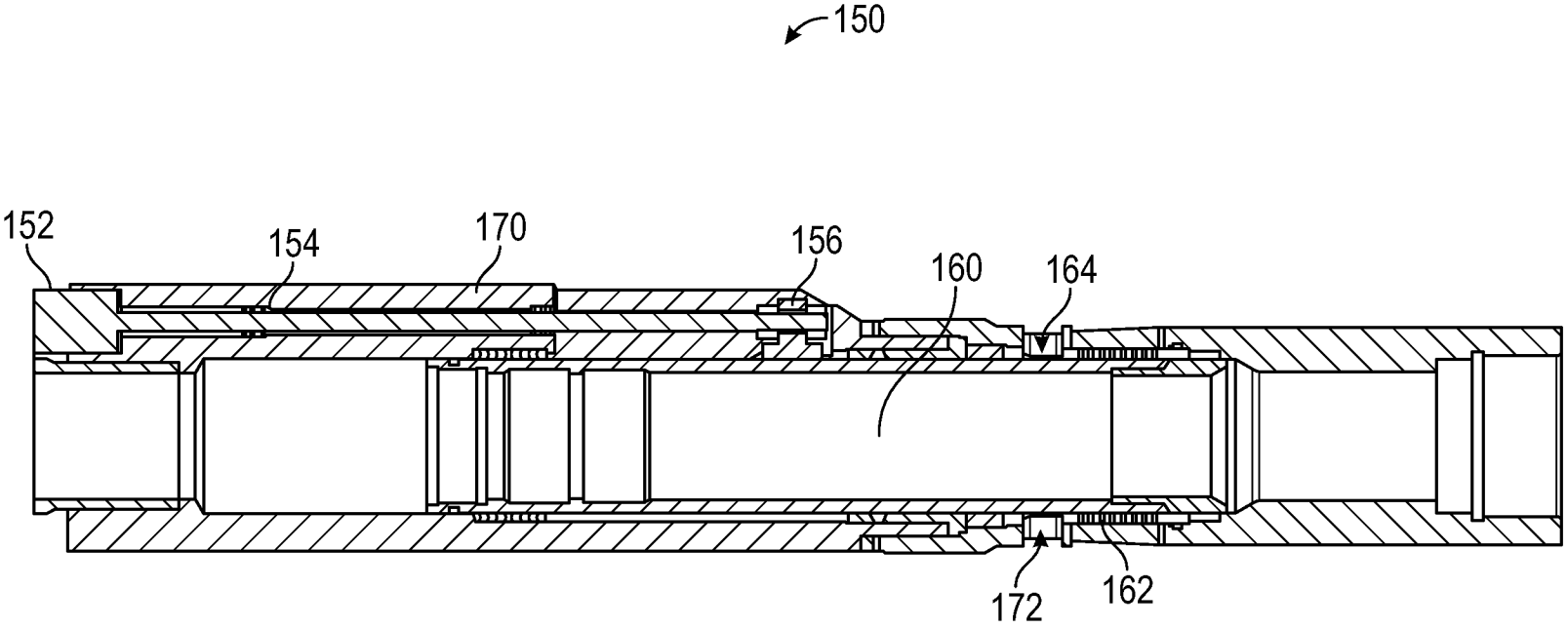
FIG. 2 shows a partial longitudinal cross-section of an example electric flow control valve.

In electric flow control valves (eFCV) 150 according to the present disclosure, a section, for example, an upper section, of the flow control valve 150 may be modified to house an electrical actuator 152, for example as shown in FIG. 2. The actuator 152 can be or include an electromechanical actuator (EMA). The EMA receives electrical power as input, e.g., from one or more electrical cables, and converts the electrical power into a translating movement. The actuator 152 or EMA includes an electric motor, a gear box or reducer, and a screw, drive shaft, or axial rod 154. The actuator 152, e.g., the drive shaft 154, can be coupled (e.g., physically or operably coupled) to an FCV sleeve 160 via a linkage mechanism 156. Translational movement of the drive shaft 154 thereby causes translational movement of the FCV sleeve 160 to open and/or close (e.g., selective uncover and/or cover) ports 164 in the choke sleeve 162. The housing 170 includes one or more ports 172 aligned with the ports 164 of the choke sleeve 162. When the sleeve 160 is shifted to uncover one or more ports 164 of the choke sleeve 162, fluid can flow through the ports 164 and port(s) 172 of the housing 170. In FIG. 2, the linkage mechanism 156 includes a nut connection to the sleeve. Other linkage mechanisms 156 are also possible.

Figure 3:
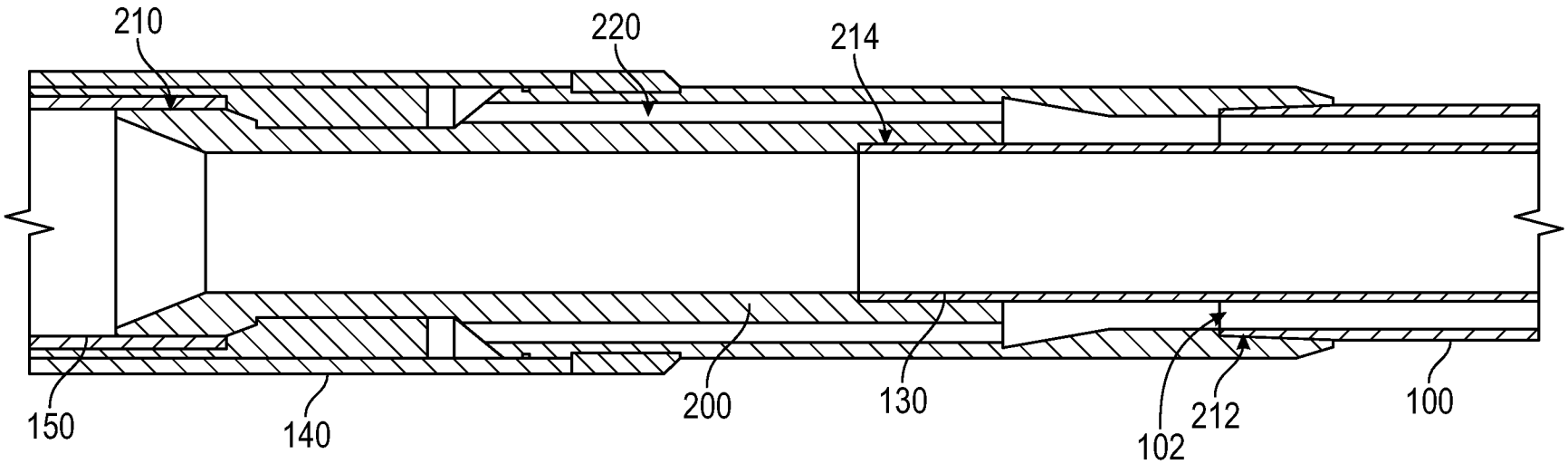
FIG. 3 shows a longitudinal cross-section of the 3-way sub of FIG. 1 coupled to an electric flow control valve, a screen, and an inner string.

A flow-through 3-way sub 200 according to the present disclosure can include three connections 210, 212, 214, for example as shown in FIG. 3, to connect the eFCV 150, the screen 100, and an inner string 130. A first connection 210 couples the 3-way sub 200 to the eFCV 150, a second connection 212 couples the 3-way sub 200 to the screen 100, and a third connection 214 couples the 3-way sub 200 to the inner string 130. The first connection 210 can be disposed at or near an uphole end of the 3-way sub 200. The second connection 212 can be disposed at or near a downhole end of the 3-way sub 200. The third connection 214 is disposed axially between the first connection 210 and the second connection 212.

In some configurations, one or more of the connections 210, 212, and/or 214 are premium thread connections. In the configuration illustrated in FIG. 3, the first connection 210 is disposed on the OD or an external surface of the 3-way sub 200 and configured to connect to a corresponding connection on the ID or an internal surface of the eFCV 150. For example, the first connection 210 can be external threads configured to engage internal threads of the eFCV 150. In the illustrated configuration, the second connection 212 is disposed on the ID or an internal surface of the 3-way sub 200 and configured to connect to a corresponding connection on the OD or an external surface of the screen 100. For example, the second connection 212 can be internal threads configured to engage external threads of the screen 100. In the illustrated configuration, the third connection 214 is disposed on the ID or an internal surface of the 3-way sub 200 and configured to connect to a corresponding connection on the OD or an external surface of the inner string 130. For example, the third connection 214 can be internal threads configured to engage external threads of the inner string 130.

Figure 8:
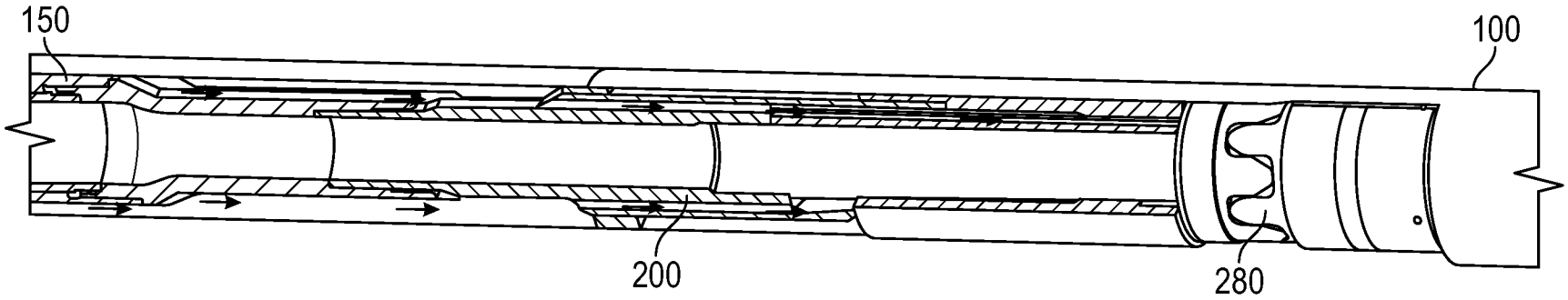
FIG. 8 shows another embodiment of the 3-way sub coupled to the valve and screen.

In other configurations, other types of connections are used instead of or in addition to threaded connections. For example, FIG. 8 illustrates a configuration including a quick connect 280 coupling for the connection 212 between and/or coupling the 3-way sub 200 and the screen 100. The connections 210, 214 between the sub 200 and eFCV 150 and between the sub 200 and inner string 130, respectively, can be threaded connections. In the illustrated configuration of FIG. 8, the quick connect 280 includes a plurality of corresponding and interlocking protrusions or teeth on the sub 200 and screen 100 sides of the connection. Other configurations are also possible. The quick connect coupling 280 can be a torque through quick connect that transmits torque. The quick connect 280 advantageously allows for avoiding rotation of the inner string 130 when making up the valve 150 to the screen 100. Avoiding rotation helps prevent or reduce the risk of the inner string 130 joints loosening if rotated on or relative to the PBR (polished bore receptacle) 134. Avoiding rotation also allows for easier assembly in the rig, as rotating assemblies with multiple bypass lines running across the interface is difficult.

Figure 4:
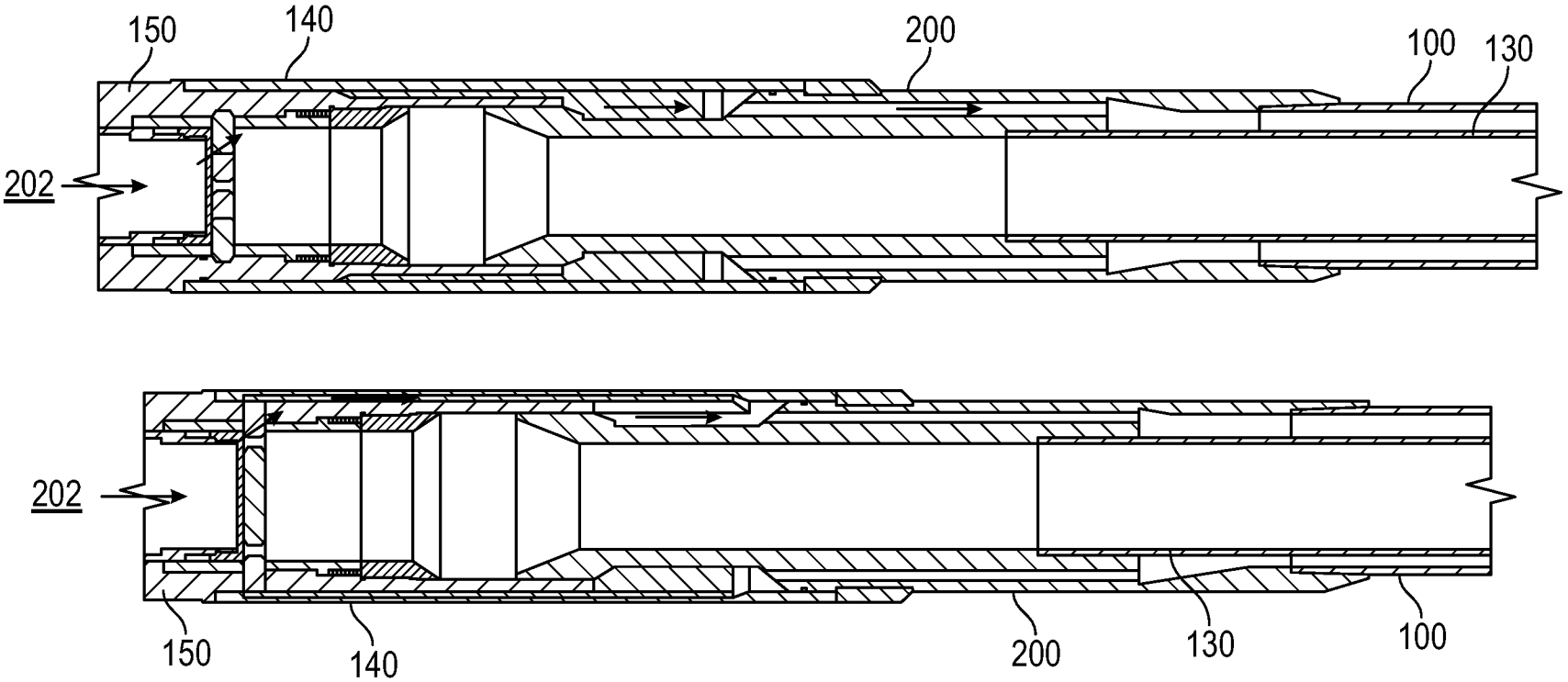
FIG. 4 shows an injection flow path from the eFCV to the screen through the 3-way sub of FIG. 3.

The 3-way sub 200 advantageously transfers tension and/or compression load from the eFCV 150 to the screen base pipe 100. The 3-way sub 200 includes one or more flow through ports 220 that channel flow from a shroud 140 to an annulus 102 of the screen 100 in use. As shown in FIGS. 1 and 3, the shroud 140 can be disposed at least partially axially between and/or overlap the eFCV 150 and the 3-way sub 200. The shroud 140 directs injection flow from the eFCV 150 to the 3-way sub 200, and the flow is then routed into the screen base pipe 100 as shown in FIG. 4. FIG. 4 shows different views or angles of the eFCV 150, 3-way sub 200, and screen 100 to show the injection flow along arrows 202. The shroud 140 creates a sand exclusion seal between the eFCV 150 and the screen 100, but does not carry axial loads.

Figure 6:
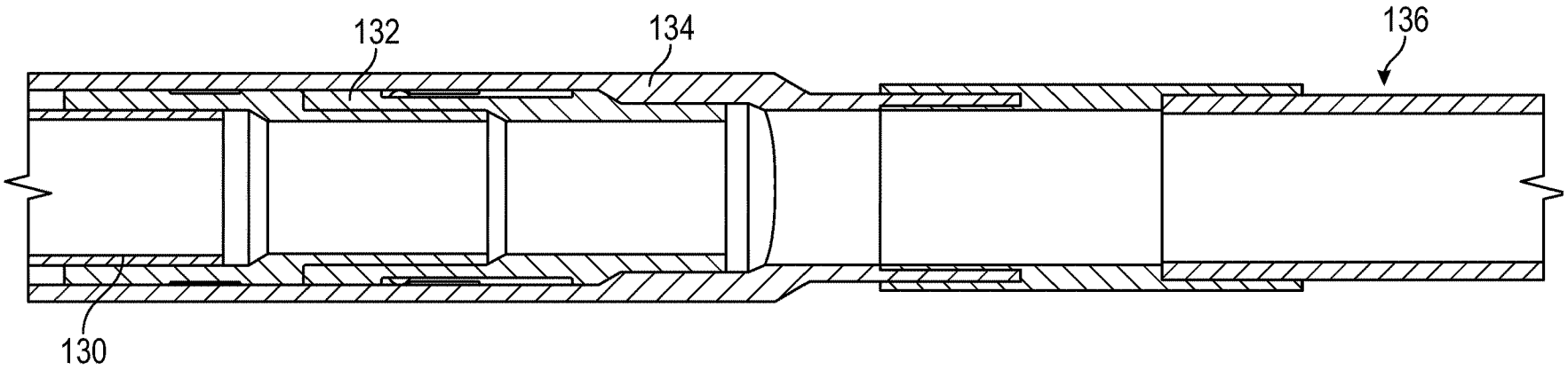
FIG. 6 shows an offset or eccentricity between the inner string and a packer.

The inner string 130 is run within the screen base pipe 100 to isolate the tubing from the injection zone. The inner string 130 can be made up of multiple 4½ tubing joints with flush joint connections. An uphole end of the inner string 130 is connected to the 3-way sub 200 via the third connection 214. A downhole end of the inner string 130 is coupled to a seal sub 132, as shown in FIG. 6. Proper space out ensures the seal sub 132 lands inside the PBR (polished bore receptacle) 134 when the screen joints are made up, as also shown in FIG. 6. A tubing swivel can be added to the inner string assembly to allow rotation if desired. Multiple screen sections can be made up together to cover the length of the zone. The bottom screen section is attached to a packer 136 with the PBR 134 located above the packer 136.

Figure 5:
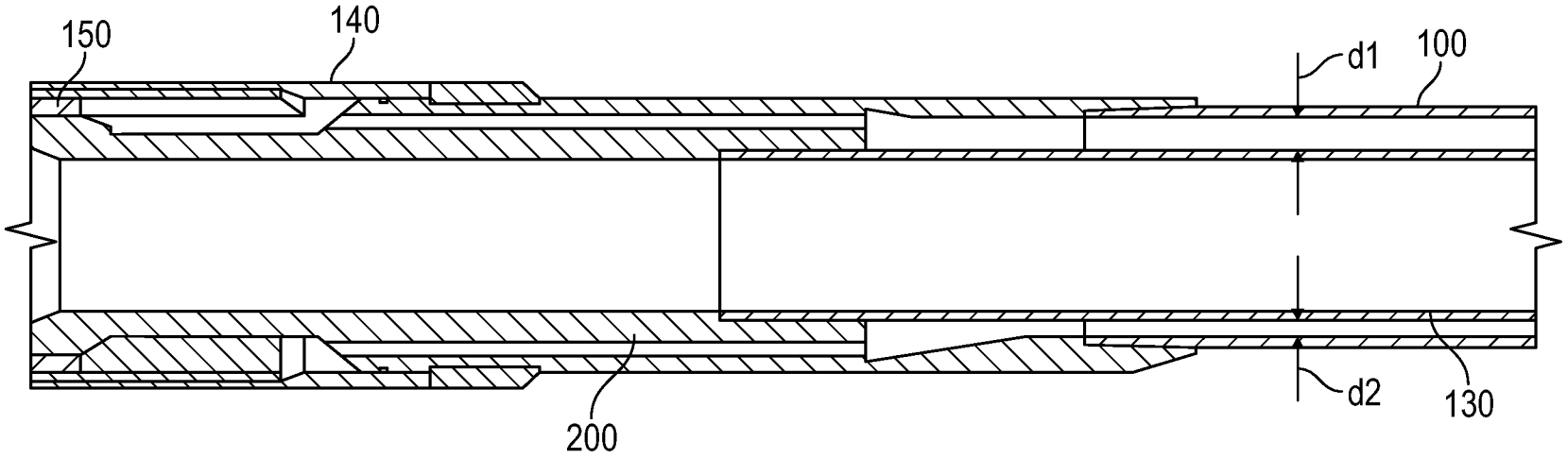
FIG. 5 shows the assembly of FIG. 3, showing the inner string offset inside the screen base pipe.

Electrical line(s) and/or other bypass line(s) can be located on the OD of the assembly, which results in eccentricity of the screen 100 and/or eFCV 150. To maintain a maximum running OD, the eccentricity of the components is aligned on the OD, and the ID is offset through the 3-way sub and the PBR 134, as shown in FIGS. 5 and 6. As shown in FIG. 5, the inner string 130 can be offset or eccentric within the screen base pipe 100. For example, the annulus radius or radial dimension d1 between the screen 100 ID and inner string 130 OD on one side of the assembly can be larger than the annulus radius or radial dimension d2 between the screen 100 ID and inner string 130 OD on another (e.g., opposite) side of the assembly. In some configurations, d1 is about 0.77 in. and d2 is about 0.65 in. As shown in FIG. 6, the inner string 130 is offset or eccentric relative to the packer 136. In some configurations, the inner string 130 has a 4 in. ID, and the packer 136 has a 4.5 in. ID, creating a 0.25 in. offset between the inner string 130 and the packer 136. In some configurations, the inner string 130 is eccentric or offset relative to the packer 136, such that a central longitudinal axis of the inner string 130 is offset from, and not aligned or parallel with, a central longitudinal axis of the packer 136.

Figure 7:
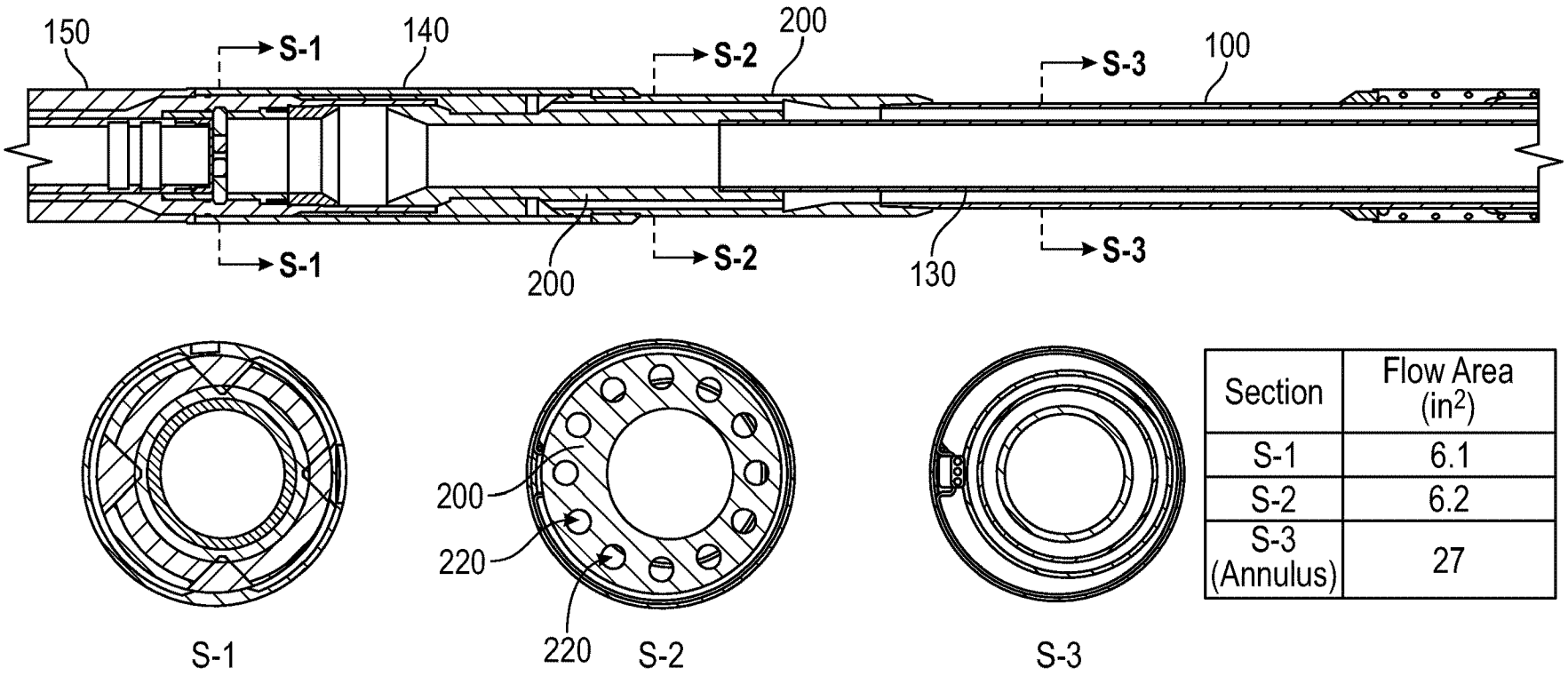
FIG. 7 shows the flow area through the eFCV, 3-way sub, and screen.

As shown in FIG. 7, the 3-way sub 200 can include multiple flow through ports 220 to increase the flow area and avoid restricting the flow between the eFCV 150 and the screen 100. In some configurations, the flow area is selected to reduce or limit erosion. For example, the flow area may be kept close to or about a 3½ tubing area. FIG. 7 also shows an example of the flow areas of the eFCV 150 and the screen 100.

The polished bore receptacle 134 is disposed above the packer 136 to provide a seal bore for the inner string 130. The PBR 134 has timed connections on both ends to align eccentricity of the screen 100 and packer 136 and to transfer tension and/or compression loads. The seal sub 132 is attached to the inner string 130 with a premium connection. Sufficient seal bore length is provided in the PBR 134 to allow margin for inner string 130 space out, tolerance stack up, and thermal effects.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A 3-way sub for integrating a screen with an electric flow control valve, the 3-way sub comprising:
- a first connection configured to couple to the electric flow control valve;
- a second connection configured to couple to the screen;
- a third connection configured to couple to an inner string disposed at least partially within the screen; and
- one or more flow through ports configured to direct flow from the electric flow control valve to an annulus of the screen.

2. The 3-way sub of claim 1, wherein the one or more flow through ports comprises a plurality of flow through ports disposed circumferentially about the 3-way sub.

3. The 3-way sub of claim 1, wherein the inner string is eccentric or offset within the screen.

4. The 3-way sub of claim 1, wherein a shroud is configured to direct the flow from the electric flow control valve to the one or more flow through ports.

5. The 3-way sub of claim 1, wherein a central bore of the 3-way sub is eccentric relative to an outer diameter of the 3-way sub.

6. An integrated screen and electric flow control valve system comprising:
- an electric flow control valve;
- a screen;
- a sub coupling the electric flow control valve to the screen, the sub disposed at least partially axially between the electric flow control valve and the screen;
- a first connection coupling the sub to the electric flow control valve;
- a second connection coupling the sub to the screen;
- an inner string disposed at least partially within the sub and the screen; and
- a third connection coupling the sub to the inner string.

7. The system of claim 6, wherein the second connection is a quick connect coupling.

8. The system of claim 6, wherein the first connection is formed between an outer surface of the sub and an inner surface of the electric flow control valve.

9. The system of claim 6, wherein the first connection is disposed at an uphole end of the sub, and the second connection is disposed at a downhole end of the sub.

10. The system of claim 6, wherein the third connection is a threaded connection.

11. The system of claim 6, wherein the third connection is formed between an inner surface of the sub and an outer surface of the inner string.

12. The system of claim 6, wherein the first connection is disposed at an uphole end of the sub, the second connection is disposed at a downhole end of the sub, and the third connection is disposed axially between the first and second connections.

13. The system of claim 6, the sub comprising one or more axially extending flow ports configured to direct injection flow from the electric flow control valve to an annulus of the screen.

14. The system of claim 13, further comprising a shroud disposed about at least a portion of the electric flow control valve and the sub, the shroud configured to direct the injection flow from the electric flow control valve to the sub.

15. The system of claim 13, wherein the annulus of the screen is formed radially between the screen and the inner string.

16. The system of claim 15, further comprising a seal sub coupled to a downhole end of the inner string.

17. The system of claim 16, wherein the seal sub is disposed within a polished bore receptacle.

18. An integrated screen and electric flow control valve system comprising:

an electric flow control valve;

a screen;

a sub coupling the electric flow control valve to the screen, the sub disposed at least partially axially between the electric flow control valve and the screen, and the sub including one or more axially extending flow ports configured to direct injection flow from the electric flow control valve to an annulus of the screen;

an inner string disposed at least partially within the sub and the screen, the annulus of the screen formed radially between the screen and the inner string; and a seal sub coupled to a downhole end of the inner string.

19. The system of claim 18, further comprising a shroud disposed about at least a portion of the electric flow control valve and the sub, the shroud configured to direct the injection flow from the electric flow control valve to the sub.

20. The system of claim 18, wherein the seal sub is disposed within a polished bore receptacle.

* * * * *